US005216988A

United States Patent [19]

Taxon

[11] Patent Number: 5,216,988

[45] Date of Patent: Jun. 8, 1993

[54] DUAL BUCKET HYDRAULIC ACTUATOR

[75] Inventor: Morse N. Taxon, West Bloomfield, Mich.

[73] Assignee: Siemens Automotive L.P., Auburn Hills, Mich.

[21] Appl. No.: 961,610

[22] Filed: Oct. 15, 1992

[51] Int. Cl.[5] ..... F01L 9/02

[52] U.S. Cl. ..... 123/90.12; 123/90.49; 74/569

[58] Field of Search ..... 123/90.12, 90.13, 90.15, 123/90.16, 90.48, 90.49, 90.55, 90.57; 74/569

[56] References Cited

U.S. PATENT DOCUMENTS

| | | | |
|---|---|---|---|
| 4,615,306 | 10/1986 | Wakeman | 123/90.16 |
| 4,671,221 | 6/1987 | Geringer et al. | 123/90.16 |
| 4,674,451 | 6/1987 | Rembold et al. | 123/90.16 |
| 4,696,265 | 9/1987 | Nohira | 123/90.16 |
| 4,796,573 | 1/1989 | Wakeman et al. | 123/90.16 |
| 4,889,084 | 12/1989 | Rembold | 123/90.12 |
| 4,889,085 | 12/1989 | Yagi et al. | 123/90.12 |
| 4,919,089 | 4/1990 | Fujiyoshi et al. | 123/90.16 |
| 4,982,706 | 1/1991 | Rembold | 123/90.12 |
| 5,005,540 | 4/1991 | Watanabe | 123/90.12 |
| 5,088,458 | 2/1992 | Wakeman et al. | 123/90.49 |
| 5,113,811 | 5/1992 | Rembold et al. | 123/90.48 |
| 5,119,774 | 6/1992 | Krieg et al. | 123/90.55 |
| 5,129,374 | 7/1992 | Flavio | 123/90.55 |
| 5,158,048 | 10/1992 | Wakeman | 123/90.16 |

FOREIGN PATENT DOCUMENTS

| | | | |
|---|---|---|---|
| 6813 | 1/1977 | Japan | 123/90.12 |
| 19903 | 2/1985 | Japan | 123/90.12 |

*Primary Examiner*—E. Rollins Cross
*Assistant Examiner*—Weilun Lo
*Attorney, Agent, or Firm*—Russel C. Wells; George L. Boller

[57] ABSTRACT

A direct acting hydraulic valve lifter, DAHVL, having dual bucket tappets is provided with means for damping the inner bucket tappet which is coupled to the engine valve. In doing so, the engine valve is damped on its closure reducing noise and wear of the engine valve. Damping is accomplished by means of side wall communication port for connecting the inner chambers of each bucket tappet which is closed by the reciprocal motion of the inner tappet as the cam closes the engine valve and a thin orifice disk controlling the flow of the fluid from the second or inner bucket to the first bucket tappet. Hydraulic pressure is multiplied by the respective areas of the tappet pistons so that the overall height of the DAHVL in a direct acting cam-valve system in reduced.

7 Claims, 1 Drawing Sheet

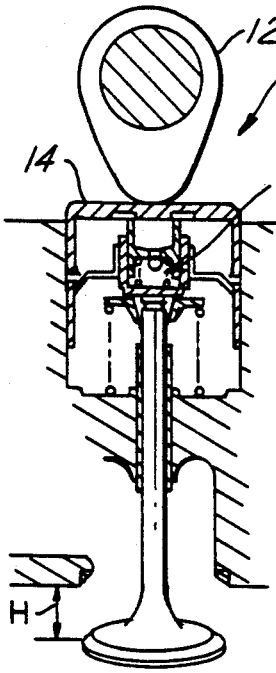
FIG. 1
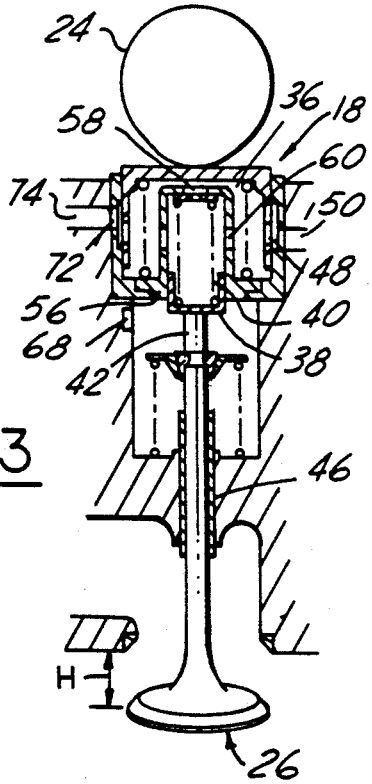
FIG. 3
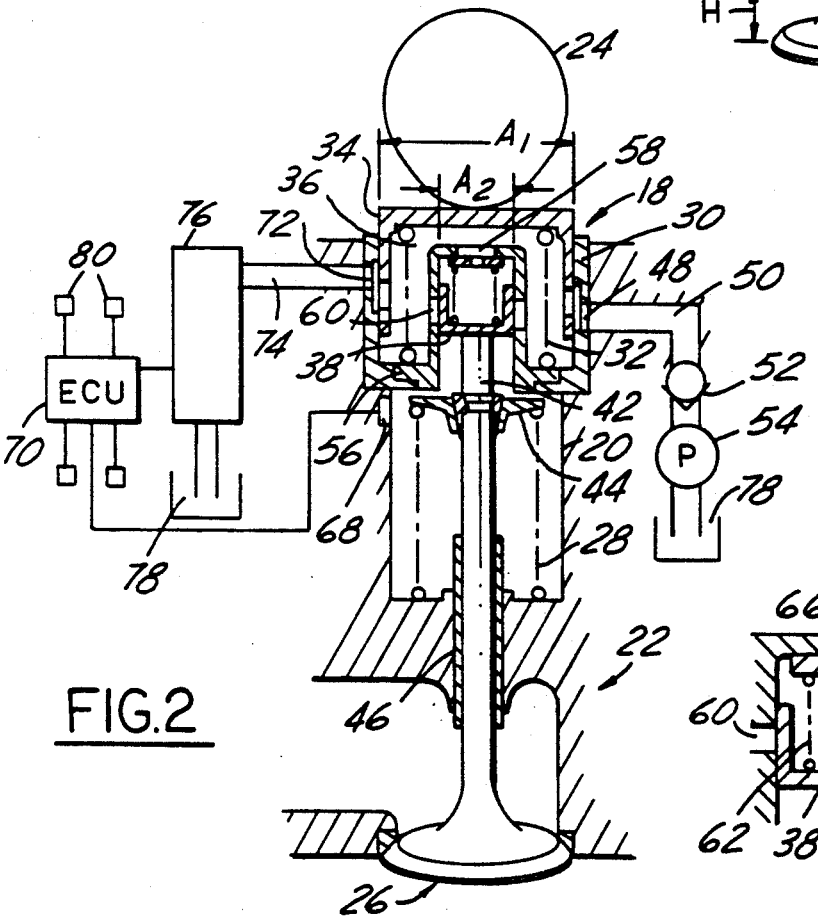
FIG. 2
FIG. 4
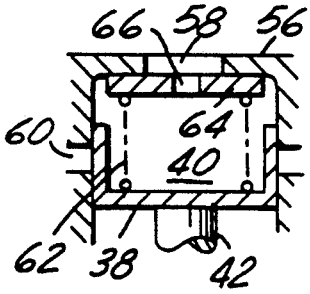

DUAL BUCKET HYDRAULIC ACTUATOR

This invention relates to electronic valve timing actuators in general and more particularly to dual bucket hydraulic actuators with damping.

BACKGROUND OF THE INVENTION

U.S. Pat. No. 5,119,774, entitled "Direct Acting Hydraulic Valve Lifter" issued on Jun. 9, 1992 by Krieg et al., describes a direct acting hydraulic valve lifter (DAHVL) having various features which individually and/or in combination may provide reduced reciprocating mass with lower oil loss in operation, faster filling of the lifter after draining and more positive discharge of air from the lifter. Vent means from the oil chambers between the hydraulic element assembly and the follower cylinder supporting it provide for the passage of air within the DAHVL.

U.S. Pat. No. 5,129,374, entitled "Hydraulic Tappet", issued on Jul. 14, 1992 by Flavio, provides structure within the tappet which causes the oil to traverse a 360° circular path and through two vertical levels in flowing from the inlet to the inner reservoir within the tappet. In this manner, any air bubbles stay in the tappet assembly but do not enter into the oil reservoir in the high pressure chamber.

U.S. Pat. No. 4,615,306, entitled "Engine Valve Timing Control System" issued on Oct. 7, 1986 by Wakeman and assigned to a common assignee, describes a system using electrohydraulic valve lifters operatively connected to an ECU to provide real time changes in engine valve timing. Pressure pulses within the system, operate to "home" the lifters to the base circle of the timing cams. The ECU controls a solenoid which controls the passage of fluid to and from the lifters.

U.S. Pat. No. 4,671,221, entitled "Valve Control Arrangement, issued on Jun. 9, 1987, by Geringer et al. describes a DAHVL wherein the in-line height of the DAHVL requires the full opening height of the valve to be the lobe height of the cam. In addition this patent shows valve damping by means of a "so-called valve brake" at the end of the closing travel of the engine valve. This brake comprises a ring shaped chamber 54 which is increasing closed by means of a gap between a projection of the housing block and a ramped shaped annular chamber. As the chamber narrows with increasing overlapping of the ramps and the face of the ring-shaped projection the fluid is squeezed until it can flow out of a smaller gap. As is well known this brake is sensitive to the viscosity of the hydraulic fluid.

U.S. Pat. No. 4,674,451, entitled "Valve Control Arrangement for Internal Combustion Engines with Reciprocating Pistons" issued on Jun. 23, 1987 by Rembold et al., describes a DAHVL having the full opening height of the valve to be the lobe height of the cam. The DAHVL is comprised of two pistons separated by a chamber which is controlled by an electromagnetically controlled directional control valve. Damping of the pistons is not a concern.

U.S. Pat. No. 4,696,265, entitled "Device for Varying a Valve Timing and Lift for an Internal Combustion Engine" issued on Sep. 29, 1987 by Nohira, describes a DAHVL used in an electronic valve timing system. Damping of the pistons and hence the engine valve is not a concern.

U.S. Pat. No. 4,796,573, entitled "Hydraulic Engine Valve Lifter Assembly does not show bucket tappets.

Again there is shown in-line pistons, in this case three, wherein a damping chamber is between a cam follower piston and a valve damping piston. An separate last adjuster piston is coaxial with respect to the previous two pistons. Damping is performed by reducing the size of the flow passages between the chambers as the pistons near their home position.

U.S. Pat. No. 5,005,540, entitled "Valve Timing Control System for an Internal Combustion Engine", issued on Apr. 9, 1991 by Watanabe, teaches a DAHVL utilizing two pistons, which appear to be similar to bucket pistons but no so described, and the ratio of their respective areas to multiply the lift of the timing cam to open the engine valve the desired amount. Damping of either of the pistons is not discussed.

U.S. Pat. No. 5,158,048 entitled "Lost Motion Actuator" by Robnett et al., and assigned to a common assignee describes a dual, first and second, piston hydraulic actuator having an orifice disk with a thin edge orifice to control damping of the second piston.

SUMMARY OF THE INVENTION

An hydraulic actuator as used in a bore in the cylinder head of an internal combustion engine is operatively positioned between a timing cam and an engine valve. The engine valve has a valve spring connected to its stem for biasing the engine valve closed in a normal position. The actuator has a tubular housing member in which is found a first bias spring and a first piston having a bucket shape forming an inner chamber. The first piston is mounted for reciprocal motion in the housing member under control of the timing cam. The first bias spring is located in the inner chamber and biases the first piston toward the timing cam. Located in the inner chamber of the first piston is a second piston also having a bucket shape forming an inner chamber. The second piston is operatively coupled to the engine valve stem and mounted for reciprocal motion to open and close the engine valve. At least one inlet means extends through the housing for receiving hydraulic fluid into the actuator.

A tubular piston guide means is mounted in the housing and is enclosed at one end. The piston guide operates to recripocally guide the second piston. The piston guide has an opening at its enclosed end for transferring fluid between the chambers of the pistons. Located in the wall of the piston guide means is a communication port for connecting the inner chambers of the first and second pistons. The port is located intermediate the ends of the piston guide means and is opened and closed by the reciprocal motion of the second piston.

Located in the inner chamber or the bucket of the second piston is a second bias spring. An orifice member is located in the piston guide means and biased across the opening by the second bias spring. The orifice member substantially inhibits the flow of fluid from the inner chamber of the second piston to the inner chamber of the first piston when the timing cam moves the first piston in a reciprocal direction toward its normally bias position. A thin orifice is centrally located in the orifice member for controlling the flow of hydraulic fluid from the inner chamber of the second piston to the inner chamber of the first piston when the second piston closes the communication port to damp the movement of the second piston during the movement of the first piston in a reciprocal direction toward its normally biased position as the engine valve closes.

Another feature of the hydraulic actuator is that the first piston has a cross sectional area equal to $A_1$ and the second piston has a cross sectional area equal to $A_2$ which is smaller than the cross sectional area of the first piston. This limits the required movement of the first piston by the ratio of the cross sectional areas to have the movement of the second piston be sufficient to fully open the engine valve. As a result, the overall height of the hydraulic actuator is reduced.

BRIEF DESCRIPTION OF THE DRAWING

In the drawings:

FIG. 1 is a section view of the prior art bucket tappet hydraulic actuator;

FIG. 2 is a sectional view of the preferred embodiment of the hydraulic actuator in its nonactuated position;

FIG. 3 is a section view of the preferred embodiment of the hydraulic actuator in is actuated position: and FIG. 4 is an enlarged section view of the end of the piston guide means showing the disk member and the thin orifice.

DETAILED DESCRIPTION

FIG. 1 illustrates a conventional prior art direct acting hydraulic valve lifter (DAHVL) 10, such as described in the above section entitled "Background of the invention" namely U.S. Pat. No. 5,119,774. The full height "H" of the engine valve to be opened is translated, on a 1:1 ratio, to the lobe height of the timing cam 12. With the styling of the motor vehicles such that any excess height interferes with the aerodynamic silhouette of the vehicle, it is desirable to reduce the overall height of the DAHVL system. In the DAHVL of FIG. 1, the two pistons are the cam follower piston 14 and the hydraulic lash adjuster 16.

Referring to FIG. 2, there is illustrated in section view the preferred embodiment of a DAHVL actuator 18 for use in a stepped bore 20 in the cylinder head 22 of an internal combustion engine. The actuator 18 is positioned between a timing cam 24 and an engine valve 26 in the engine block or cylinder head of the engine. A valve spring 28 is operatively connected to the engine valve 26 for biasing the engine valve closed.

The DAHVL actuator 18 has a tubular housing member 39, a first bias spring 32, a first piston 34 having a bucket shape forming a first inner chamber 36. The first piston 34 is mounted for reciprocal motion in the housing member 30 under control of the timing cam 24 and biased toward the timing cam by the first bias spring 32.

In addition, there is a second piston 38 having a bucket shape forming a second inner chamber 40. The second piston 38 is operatively coupled to the engine valve 26 through an elongated valve stem 42. In the present embodiment, the second piston rests on the top of the valve stem 41 and is maintained there by means of the hydraulic pressure pushing on the second inner chamber 40. The second piston 38 is mounted for reciprocal motion to open and close the engine valve. The valve spring 28 is mounted between the bottom of the enclosed bore 20 and a spring retainer bracket 44 mounted on the valve stem 42 at a point intermediate the ends of the stem. The valve stem 42 is slideably located in a guide means 46 in the cylinder head 22. In the present embodiment, the cylinder head 22 maybe be part of a special valve cover or other member that is secured to the engine.

At least one inlet means 48 is shown extending through the housing for receiving the hydraulic fluid from a first passageway 50. The first passageway 50 is connected through a one-way valve 52 to a pump 54. The pump 54 operates in a conventional manner to pump the hydraulic fluid from its source 78 to the DAHVL 18.

Mounted coaxial with the first piston 34 in the housing 30 is a tubular piston guide means 56. One end of the tubular piston guide means 56 is enclosed and has an opening 58 in that end for transferring fluid between the first and second inner chambers 36,40 of the two pistons 34,38. The function of the tubular piston guide means 56 is to reciprocally guide the second piston 38 along the inner surface of the guide means 56.

Intermediate the ends of the piston guide means 56 is at least one communication port 60 extending through the guide means wall. It is the function of this communication port 60 to connect the first and second inner chamber 36,40 of the first and second pistons 34,38 for aiding the flow of hydraulic fluid. As will hereafter be described, the communication port 60 is opened and closed by the reciprocal motion of the second piston 38. When the second piston is reciprocating in the direction to open the engine valve 26, the opening of the communication port 60 allows for additional hydraulic fluid to flow into the second inner chamber 40 in addition to the fluid flowing through the opening 58 at the end of the tubular piston guide means 56. Conversely when the communication port is closed by the second piston, this forces all of the fluid to flow in the direction of the opening at the end of the tubular piston guide means.

Mounted between the end of the tubular piston guide means 56 and the bottom of the second inner chamber 40 in the second piston 38 is a second bias spring 62. One of the functions of this second bias spring 62 is to maintain spacing between the end of the guide means 56 and the bottom of the second inner chamber 40 in the second piston 38. This second bias spring 62 is not strong enough to overcome the force of the valve spring 28.

As illustrated in FIG. 4, located across the end of the tubular guide means 56 is an orifice member 64. This orifice member 64 is biased against the end of the guide means 56 by the second bias spring 62. This is another function of the second bias spring. When the fluid is flowing from the first inner chamber 36 to the second inner chamber 40, the second bias spring 62 is not strong enough to keep the orifice member 64 against the end of the tubular guide means 56 and the fluid flows around the member into the second inner chamber.

Centrally located in the orifice member 64 is a thin orifice 66 for controlling the flow of hydraulic fluid from the second inner chamber 40 of the second piston to the first inner chamber 36 of the first piston. This takes place when the timing cam 24 operates to close the engine valve 26. The thin orifice 66 operates to substantially inhibit the flow of fluid from the second inner chamber 36 of the second piston to the first inner chamber 40 of the first piston when the timing cam 24 operates to close the engine valve 26. At this time the first piston 38 is moving in a second reciprocal direction toward its normal position as biased by the valve spring 28. As the second piston 38 closes the communication port 60 in the guide means 56, the restriction to the flow of the fluid through the thin orifice 66 operates to damp the movement of the second piston 38, hence the closing of the engine valve 26.

The first piston 34 has a cross sectional area equal to $A_1$ and the second piston 38 has a cross sectional area equal to $A_2$ which is smaller than the cross sectional area of the first piston 38. Thus the fluid pressure generated by the movement of the first piston 38 by the timing cam 24 operates on the small area $A_2$ operates to multiply the lobe height on the timing cam 28 to open the engine valve 26 the desired distance "H". This multiplication will allow the overall height of the DAHVL to be reduced over that of the prior art and permit the aerodynamic flow characteristics of the motor vehicle to that as desired.

The distance between the end of the tubular piston guide means 56 and the communication port 60 determines the position of the engine valve 26 at which damping begins. The size of the thin orifice 66 determines the magnitude or degree of the damping irrespective of the total time of damping irrespective of the viscosity of the hydraulic fluid. To achieve the thin orifice 66, the edges of the orifice may be chamfered if the predetermined thickness of the orifice disk 64 is greater than the desired thickness of the thin edge. This operates to reduce the length of the orifice 66. This damping mechanism provides for lower valve seating velocities and therefore reduces noise and wear.

In order to determine the position of the valve 26, especially when the valve is seated, switch means 68 such as a reed switch, a contact switch or a proximity switch may be positioned between the bottom of the second piston 38 and the top of the spring retainer bracket 44 The switch means 68 is electrically connected to an electronic control unit 70, ECU, an as a result of its actuation, the ECU 70 receives a signal indicating the seating of the engine valve 26.

The tubular housing member 30 has at least one outlet means 72 through its wall for discharging hydraulic fluid from the housing 30. As illustrated in FIGS. 2 and 3, the first passageway 50 from the pump 54 enters the housing 30 at a point which is spaced below the second passageway 74 from the outlet means 72. This allows for the passage of any air bubbles or other fluid characteristics which substitutes air for fluid. As an enhancement to have the air bubbles flow though the housing, the first passageway 50 may be inclined causing the bubbles to flow along the upper of higher surface of the first passageway 50.

A solenoid valve means 76 operates to control the discharge of the hydraulic fluid from the housing 30 to the source 78 of hydraulic fluid. The solenoid valve 76 is an electromagnetically controlled valve which is controlled the ECU 70 which is responsive to various sensed engine parameters 80. These parameters define when the engine valve 26 should be opened and closed for best engine operation. If both the opening and the closing of the engine valve 26 are controlled, the best engine operation can be had.

There has thus been illustrated and described an hydraulic actuator and electronic valve timing system for electronically controlling the timing of the operation of the engine valves in an internal combustion system.

What is claimed is:

1. An hydraulic actuator for use in a bore in the cylinder head of an internal combustion engine and coupled between a timing cam and an engine valve, a valve spring operatively connected to the engine valve for biasing the engine valve closed, a tubular housing member, a first bias spring, a first piston having a bucket shape forming a first inner chamber, the first piston mounted for reciprocal motion in the housing member under control of the timing cam and normally biased toward the timing cam by the first bias spring, a second piston having a bucket shape forming a second inner chamber, the second piston is operatively coupled to the engine valve and mounted for reciprocal motion to open and close the engine valve, at least one inlet means through the housing for receiving hydraulic fluid, the actuator characterized in that:

tubular piston guide means mounted in the housing and enclosed at one end for reciprocally guiding the second piston, said guide means having an opening at the enclosed end for transferring fluid between the first and second inner chambers;

a communication port in the wall of said tubular piston guide means for connecting the inner chambers of the first and second pistons, said port being located intermediate the ends of said guide means and being opened and closed by the reciprocal motion of the second piston;

a second bias spring mounted in the bucket of the second piston;

an orifice member located in said tubular guide means and biased across said opening by said second bias spring, said member substantially inhibiting the flow of fluid from the second inner chamber of the second piston to the first inner chamber of the first piston when the timing cam moves the first piston in a second reciprocal direction toward its normally bias position; and a thin orifice centrally located in said orifice member for controlling the flow of hydraulic fluid from the second inner chamber of the second piston to the first inner chamber of the first piston when the second piston closes said communication port for providing damping of the second piston during the movement of the first piston in a second reciprocal direction toward its normally biased position.

2. A hydraulic actuator for use in a bore in the cylinder head of an internal combustion engine according to claim 1 wherein the first piston has a cross sectional area equal to A1 and the second piston has a cross sectional area equal to A2 which is smaller than said cross sectional area of said first piston for multiplying the lobe height on the timing cam to equal the desired opening distance of the engine valve.

3. A hydraulic actuator for use in a bore in the cylinder head of an internal combustion engine according to claim 1 wherein said second piston is coupled to the valve stem of the engine valve and biased toward said one end of said tubular piston guide means.

4. A hydraulic actuator for use in a bore in the cylinder head of an internal combustion engine according to claim 3 wherein the valve stem has a spring retainer bracket for limiting one end of the valve spring and additionally including a switch means positioned to be actuated by said spring retainer bracket for indicating the position of the valve stem and therefore the position of the engine valve.

5. A hydraulic actuator for use in a bore in the cylinder head of an internal combustion engine according to claim 3 wherein the valve stem has a spring retainer bracket for limiting one end of the valve spring and additionally including a switch means positioned to be actuated by said second piston for indicating the position of the engine valve.

6. A hydraulic actuator for use in a bore in the cylinder head of an internal combustion engine according to claim 1 wherein the distance between the end of said tubular piston guide means and said communication port determines the position of the engine valve when damping begins and the size of said orifice determines the magnitude of damping irrespective of the viscosity of the hydraulic fluid.

7. A hydraulic actuator for use in a bore in the cylinder head of an internal combustion engine according to claim 1 wherein said orifice member is of a predetermined thickness and the surface around the orifice is chamfered to reduce the length of said orifice to produce a thin sharp edge around said orifice.

* * * * *